US006587570B1

(12) United States Patent
Pavlovic

(10) Patent No.: US 6,587,570 B1
(45) Date of Patent: Jul. 1, 2003

(54) ELECTROACOUSTIC TRANSDUCER

(75) Inventor: Gino Pavlovic, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 0 days.

(21) Appl. No.: 09/067,879

(22) Filed: Apr. 28, 1998

(30) Foreign Application Priority Data

Apr. 30, 1997 (AT) ..... 755/97

(51) Int. Cl.[7] ..... H04R 25/00

(52) U.S. Cl. ..... 381/400; 381/407; 381/412; 381/419; 381/423

(58) Field of Search ..... 381/400, 407, 381/423, 430, 412, 419, 420

(56) References Cited

U.S. PATENT DOCUMENTS

| | | | | | |
|---|---|---|---|---|---|
| 2,392,143 | A | * | 1/1946 | Graham | 179/115.5 |
| 4,532,383 | A | * | 7/1985 | Willy | 381/423 |
| 5,526,441 | A | * | 6/1996 | Codina et al. | 381/202 |
| 5,715,324 | A | * | 2/1998 | Tanabe et al. | 381/400 |

FOREIGN PATENT DOCUMENTS

| | | |
|---|---|---|
| AT | 294213 | 11/1971 |
| DE | 2822680 | 12/1978 |
| DE | 3321278 | 12/1983 |
| DE | 4312159 | 6/1994 |
| FR | 2428951 | 1/1980 |
| GB | 968951 | 10/1961 |
| GB | 2139851 | 11/1984 |

OTHER PUBLICATIONS

Patent Abstracts of Japan, 58153496, Dec. 9, 1983, Sanyo Electric Co. Ltd.
Patent Abstracts of Japan, 03220897, Sep. 30, 1991, Matsushita Electric Ind Co Ltd.
Patent Abstracts of Japan, 56146400, Nov. 13, 1981, Matsushita Electric Ind Co Ltd.
Patent Abstracts of Japan, 57168599, Oct. 16, 1982, Matsushita Electric Corp.
Patent Abstracts of Japan, 03273800, Dec. 4, 1991, Matsushita Electric Ind Co Ltd.

* cited by examiner

*Primary Examiner*—Rexford Barnie
*Assistant Examiner*—Dionne Harvey
(74) *Attorney, Agent, or Firm*—Friedrich Kueffner

(57) ABSTRACT

An electroacoustic transducer operating in accordance with the electrodynamic principle include a diaphragm which has in the region of the coil an annular protrusion which is integrally connected to the diaphragm, wherein the coil is attached, preferably glued, to the annular protrusion at a desired distance from the diaphragm. The attachment can be end face against end face. The diaphragm may in the area of the coil have an annular reinforcing corrugation which is attached to the coil in an appropriate manner, preferably by gluing.

5 Claims, 2 Drawing Sheets

ELECTROACOUSTIC TRANSDUCER

BACKGROUND OF THE INVENTION

1. Field of the Invention

The present invention relates to an electroacoustic transducer.

2. Description of the Related Art

Electroacoustic transducers which operate in accordance with the electrodynamic principle include a diaphragm which is connected to a foil. The foil protrudes into the annular slot between the poles of a magnet and the movement of the coil produces the conversion of acoustic energy into electrical energy, or vise versa.

In order to achieve a high efficiency and a good quality with respect to a low distortion factor, it is desirable that the movement of the coil takes place within a portion of the magnetic field in which it is has the highest possible intensity and a good linearity, i.e., in the air gap of the magnet yoke itself.

Another requirement to be made of the diaphragm or its surroundings is that the diaphragm is to be capable of freely moving within an amplitude which is as large as possible, without making contact with any structural components. This requirement is contradictory to the first requirement because the coil itself is seated on the diaphragm and, thus, the yoke of the magnet must also be located close to the diaphragm which, in turn, significantly limits the freedom of movement of the diaphragm in the direction of the magnet.

In order to eliminate this problem, it has become known in the art to glue a coil carrier onto the diaphragm, wherein the coil carrier essentially has the shape of a cylindrical casing and includes an adhesive edge to be glued to the diaphragm. At a distance from the diaphragm, the coil is then glued to the coil carrier, so that the diaphragm may have a greater distance from the magnet, while the coil is still located in the best possible position in the magnet yoke. Although this solution appears to be excellent at first glance, it is difficult to realize: An additional component, namely, the coil carrier, is required. This coil carrier must be glued to the diaphragm which results in problems with respect to manipulation because the diaphragm is comprised of a sensitive thin skin, i.e., conventional thicknesses of diaphragms are in the order of magnitude of 40 micrometers or frequently even thinner, which makes it necessary as a result to mount the coil on the diaphragm carrier; this is also extremely problematic because it is not easy to secure the diaphragm carrier. In addition to all of that, there are tolerance and adjustment problems caused by the additional structural component which cannot be ignored.

All of the problems discussed above occur in a product which is usually manufactured with a high cycle speed, wherein cycle speeds of 6 seconds for each work step are quite conventional, which means that the devices used must meet high requirements. On the other hand, if smaller quantities are manufactured, there are significant problems with respect to gluing, particularly gluing of the coil carrier to the diaphragm, because it is almost impossible to sufficiently apply adhesive without errors to the tiny available gluing surfaces.

SUMMARY OF THE INVENTION

Therefore, it is the primary object of the present invention to provide an electroacoustic transducer of the above-described type in which the problems described above are eliminated and a solution is provided which does not require the use of a coil carrier, while still making it possible to arrange the coil father away from the actual diaphragm plane and, thus, to position the coil better in the magnet yoke.

In accordance with the present invention, the diaphragm has in the region of the coil an annular protrusion which is integrally connected to the diaphragm, wherein the coil is attached, preferably glued, to the annular protrusion at a desired distance from the diaphragm.

In accordance with a preferred feature, the attachment is effected end face against end face, which is in contrast to conventional, specifically manufactured coil carriers which support the coil on the outer circumferential surface thereof.

In accordance with another embodiment, the diaphragm has in the area of the coil an annular reinforcing corrugation which is attached to the coil in an appropriate manner, preferably by gluing.

The present invention is based on the finding that it is possible by using the deep-drawing method to shape the diaphragm in such a way that a coil carrier can be formed integrally with the diaphragm material at the same time the diaphragm is manufactured. Since this shaping is effected in the same tool and the same method step as the shaping of the diaphragm, there are no tolerance or adjustment problems. The previously necessary separate coil carrier component is unnecessary and fastening of the coil to the protrusion according to the present invention is as unproblematic as it was in the past to mount the coil directly on the diaphragm without the use of a coil carrier.

Another advantage is the fact that an additional oscillating mass is missing, as it was in the past always formed by the coil carrier; this has a particularly positive effect on the conversion of high frequencies.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
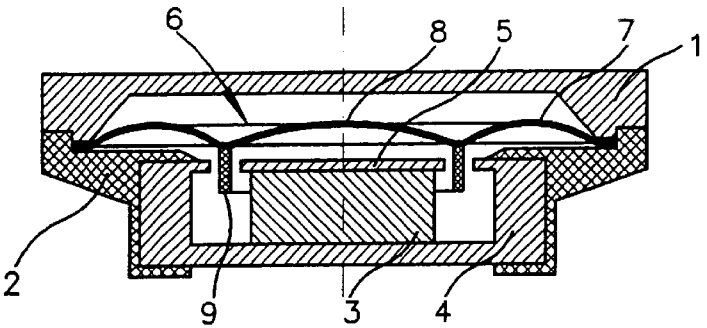
FIG. 1 PRIOR ART
FIG. 1 is a schematic sectional view of an electrodynamic transducer according to the prior art.

As illustrated in FIG. 1 of the drawing, a magnet 3 and a two-part yoke 4, 5 are provided in a capsule composed of an upper part 1 and a lower part 2. Also provided is a diaphragm 6 which is conventionally clamped with its circular rim between the capsule parts 1 and 2 or is glued in this area; this diaphragm 6 is divisible into a rim portion 7 and a central portion 8. The central portion 8 constitutes the essential portion of the diaphragm and a coil 9 is mounted, usually glued, along the circumference of this central portion 8.

In the case of a microphone, the diaphragm 6 is moved by the impinging sound waves, moves the coil 9 as a result in the slot of the yoke 4, 5 and, thus, induces in the coil windings a voltage which is then derivated and evaluated or used. In the case of a headset or loudspeaker, when current flows in the coil 9, the diaphragm 6 is oscillated and sounds are radiated.

Figure 2:
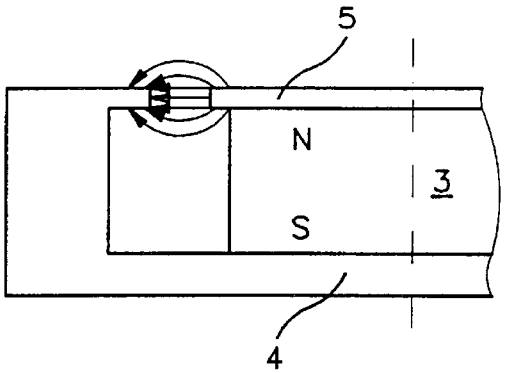
FIG. 2 PRIOR ART
FIG. 2 is a schematic sectional view showing the magnetic components of the transducer of FIG. 1.

As can be seen in FIG. 2, the magnetic field between the outer surfaces of the yoke parts 4, 5 of the magnet 3 which face each other is practically homogenous, when not taking into consideration that the circumference of the outer yoke part is greater than the circumference of the inner yoke part, so that the magnetic field lines extend radially and not parallel to each other; however, this is negligible in view of the small relative differences in length.

In the areas above and below the outer surfaces, these field lines are also bent in axial direction and, thus, the field is to a high extent inhomogeneous.

Figure 3:
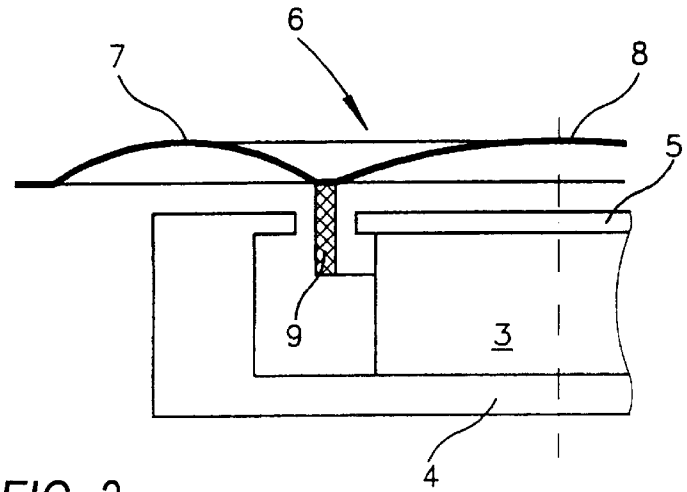
FIG. 3 PRIOR ART
FIG. 3 is a sectional view, on a larger scale, showing a detail of the transducer of FIG. 1.

As can be seen in FIG. 3, it is necessary to provide the coil 9 with an axial length which, on the one hand, covers the entire amplitude range of the movement of the diaphragm 6 and, in addition, also covers the actually dead space which constitutes a quiet distance between the diaphragm and the end of the magnetic yoke 4, 5 on the side of the diaphragm.

This configuration known from the prior art has the disadvantage that a great portion of the moving coil 9 always moves within the range of the inhomogeneous magnetic field, which leads to distortions in the transmission and to a lower efficiency, independently of whether it is used in a microphone or headset capsule.

Figure 4:
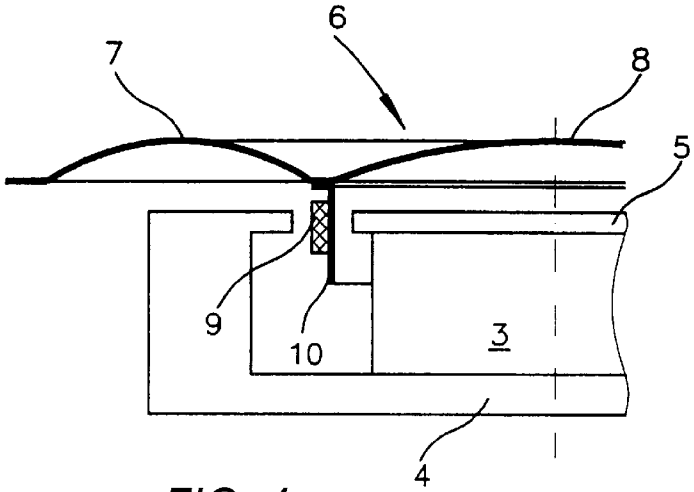
FIG. 4 PRIOR ART
FIG. 4 is a sectional view showing a detail of a transducer according to the prior art with a coil mounted on a coil carrier.

In order to eliminate these problems, it is known in the prior art as illustrated in FIG. 4, to glue a cylindrical coil carrier 10 to a diaphragm 6 at the transition between the corrugated portion 7 and the arc-shaped portion 8, wherein the coil 9, in turn, is glued to the outer surface of the coil carrier 10. The manipulation of the coil carrier 10, the connection of the coil carrier 10 to the diaphragm 6 and, finally, gluing the coil 9 to the coil carrier 10 has the disadvantages described above.

In addition, there is the mass of the coil carrier 10 which negatively affects the transmission properties in the high-frequency range. In contrast, the present invention makes it possible to omit such an additional mass, so that this disadvantage of the known solutions is avoided.

Figure 6:
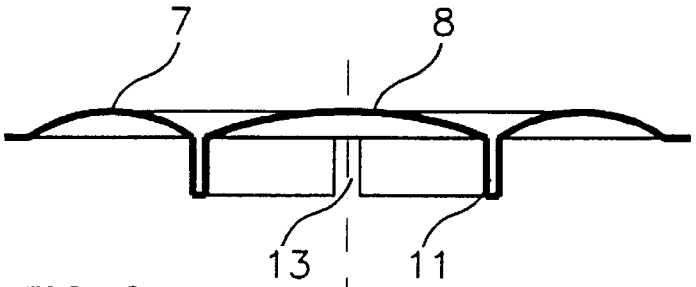
FIG. 6 is a sectional view of another embodiment of diaphragm according to the present invention.
Figure 5:
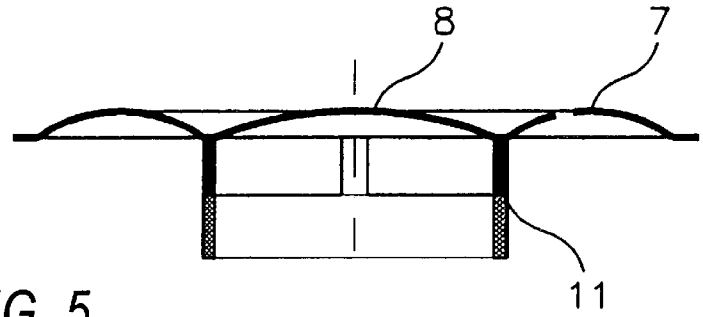
FIG. 5 is a sectional view of the diaphragm according to the present invention.

In accordance with the present invention, the diaphragm 6 has a shape as it is illustrated in FIG. 5 or 6, wherein the transition portion between the corrugated region 6 and the arc-shaped region 8 is pulled axially downwardly toward the magnet system, so that an approximately annular protrusion 11 is produced which serves as a coil carrier.

As illustrated in FIG. 5, this protrusion may be composed of a cylindrical portion which may have a greater wall thickness than the other diaphragm portions or, as shown in FIG. 6, it may be constructed groove-shaped in the axial cross-section.

Figure 7:
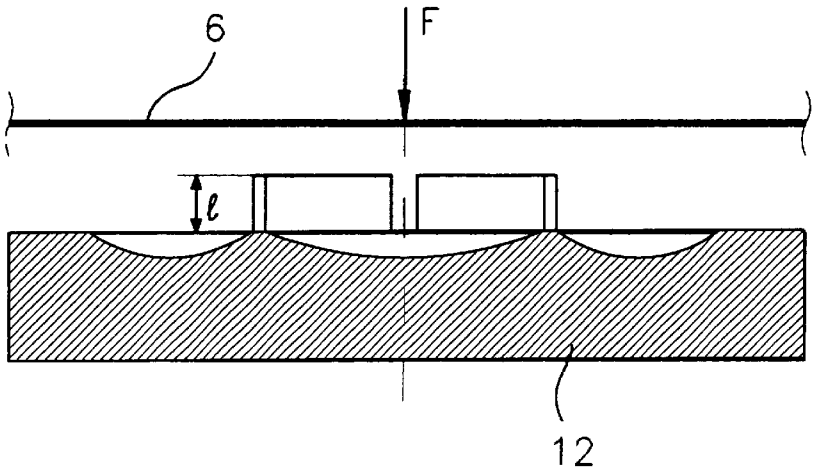
FIG. 7 is a sectional view of a die to be used for manufacturing a diaphragm according to the present invention.

A groove-shaped configuration is achieved, for example, by using a die tool as shown in FIG. 7 in which a blank of the diaphragm 6 is pulled over a die 12 in accordance with the deep-drawing method by applying pressure and in most cases also by thermally treating the blank. The height 1 of the die protrusion determines the height of the coil carrier 11.

The embodiment according to FIG. 5 can be produced by using a die which is arranged on that side of the foil 6 which later faces the magnet system, wherein the foil material is pressed appropriately into a recess of the die. This die can be used especially in the case of foil material which has good deep-drawing properties. In that case, it is also possible to use a pressure die instead of the excess pressure on the side of the foil facing away from the die. Possible materials of the foil are, for example, polycarbonate, polyether esterurethane or PETP-foil, for example, Mylar.

The configuration of the diaphragm according to the present invention also makes it possible to achieve a stiffening of the arc-shaped portion 8 which is desirable for avoiding parasite oscillations. This also advantageously connects the air volume underneath the corrugated portion to the air volume underneath the arc-shaped portion.

Figure 8:
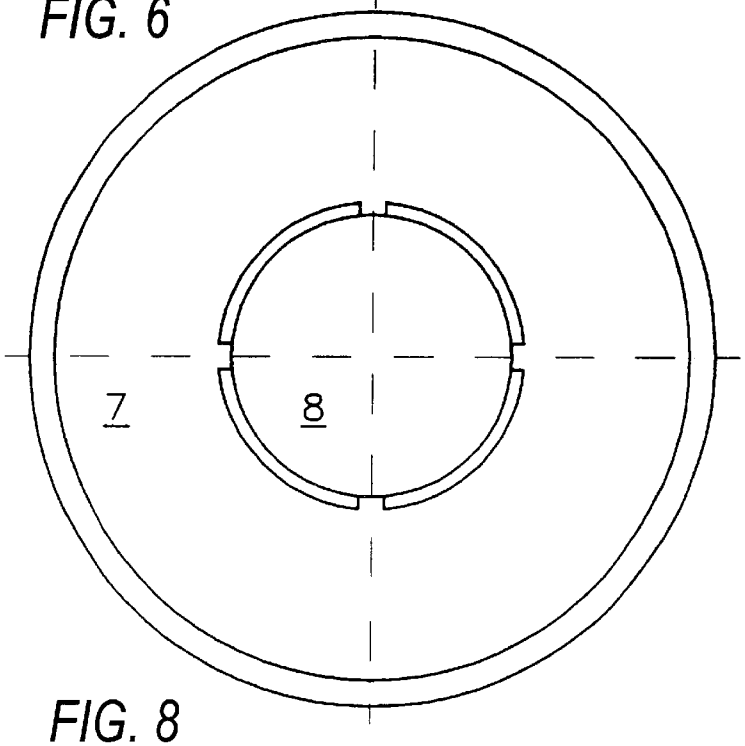
FIG. 8 is a top view of yet another embodiment of the diaphragm according to the present invention.

This connection can be effected, for example, as illustrated in FIG. 8, by providing the protrusion 11 not over the entire circumference of the arc-shaped portion 8 but by providing continuous bridges 13 between the corrugated portion 7 and the arc-shaped portion 8, which may be particularly advantageous in the configuration of the protrusion according to FIG. 6. The interruption of the protrusion 11 which forms an only small gap does not impair the attachment and gluing of the moving coil 9.

All previously known methods and procedures and measures for improving the frequency pattern, etc., can be used in the diaphragm according to the present invention. Thus, naming or identifying corrugations can be provided in the corrugated portion 7, the arc-shaped portion 8 can be provided with stiffenings, a second stiffening layer, or with a greater thickness, and all measures concerning improvement and configuration which are conventional in the manufacture of electroacoustic transducers can be used.

The present invention is applicable to the materials which are presently conventional in this field and are known to the experts, wherein, of course, the experts will prefer those materials of the diaphragm 6 which have an especially favorable deep-drawing behavior in order to achieve a height l of the annular protrusion 11 which is as large as possible without resulting in manufacturing problems. Axial dimensions of the protrusion of up to 3 mm can be achieved without problems, wherein the initial foil for manufacturing the diaphragm preferably has a thickness of 20–80 micrometers.

The present invention is not limited to the embodiment described above; rather, the invention can be modified in various ways. For example, the end face of the integrated coil carrier on which the coil is fastened may have a special geometry, for example, a step configuration, in order to facilitate assembly. Also, in view of the invention, those skilled in the art can utilize materials they are more familiar with than those materials indicated above.

While specific embodiments of the invention have been shown and described in detail to illustrate the inventive principles, it will be understood that the invention may be embodied otherwise without departing from such principles.

I claim:

1. An electroacoustic transducer operating in accordance with the electrodynamic principle, the transducer comprising a diaphragm, a coil connected to the diaphragm, wherein the coil projects into an annular slot between poles of a magnet system, wherein an initial foil for manufacturing the diaphragm has a thickness of 20–80 micrometers, the diaphragm comprising an annular protrusion integrally formed with the diaphragm, wherein the annular protrusion projects from a side of the diaphragm facing the magnet system and has an end face facing the magnet system, wherein the coil is attached to the end face of the annular protrusion and projects away from the annular protrusion, and wherein the annular protrusion has a groove-shaped cross-section.

2. The electroacoustic transducer according to claim 1, wherein the annular protrusion has a groove-shaped cross-section.

3. An electroacoustic transducer according to claim 1, wherein the annular protrusion has bridge-shaped interruptions extending in a circumferential direction of the annular protrusion.

4. The electroacoustic transducer according to claim 3, wherein the annular protrusion has four bridge-shaped interruptions.

5. The electroacoustic transducer according to claim 1, wherein the diaphragm has a thickness of about 40 micrometers.

* * * * *